US008217967B2

(12) United States Patent
Tomita

(10) Patent No.: US 8,217,967 B2
(45) Date of Patent: Jul. 10, 2012

(54) DISPLAY, LIQUID CRYSTAL DISPLAY, AND DATA PROCESSING METHOD FOR REDUCING INTERFERENCE DUE TO NOISE

(75) Inventor: Hideo Tomita, Kanagawa (JP)

(73) Assignee: Sony Corporation, Tokyo (JP)

( * ) Notice: Subject to any disclaimer, the term of this patent is extended or adjusted under 35 U.S.C. 154(b) by 911 days.

(21) Appl. No.: 11/452,886

(22) Filed: Jun. 14, 2006

(65) Prior Publication Data

US 2006/0284818 A1 Dec. 21, 2006

(30) Foreign Application Priority Data

Jun. 16, 2005 (JP) ..... P2005-176375

(51) Int. Cl.
*G09G 5/10* (2006.01)
*G09G 5/02* (2006.01)

(52) U.S. Cl. ..... 345/690; 345/596

(58) Field of Classification Search ..... 345/596–600, 345/204, 611–616, 690; 341/131
See application file for complete search history.

(56) References Cited

U.S. PATENT DOCUMENTS

| | | | | |
|---|---|---|---|---|
| 5,598,184 | A * | 1/1997 | Barkans | 345/597 |
| 5,714,975 | A * | 2/1998 | Spackman | 345/596 |
| 5,963,157 | A * | 10/1999 | Smith | 341/131 |
| 6,046,725 | A * | 4/2000 | Yoon | 345/88 |
| 6,469,708 | B1 * | 10/2002 | Wu et al. | 345/596 |
| 7,002,594 | B2 * | 2/2006 | Yoshida et al. | 345/600 |
| 7,259,757 | B2 * | 8/2007 | Maehara | 345/204 |
| 7,391,398 | B2 * | 6/2008 | Inoue | 345/89 |
| 7,738,000 | B2 * | 6/2010 | Furukawa et al. | 345/690 |
| 2004/0145792 | A1 * | 7/2004 | Maeyama et al. | 359/205 |

FOREIGN PATENT DOCUMENTS

JP 03-291691 12/1991

* cited by examiner

*Primary Examiner* — Adam J Snyder
(74) *Attorney, Agent, or Firm* — Frommer Lawrence & Haug LLP; William S. Frommer; Ellen Marcie Emas

(57) ABSTRACT

Disclosed herein is a display including, a digital signal processing circuit that processes pixel data, a digital-to-analog conversion circuit that converts pixel data that has been subjected to signal processing into an analog signal for driving a display device, and an error data addition circuit that is provided at a previous stage of the digital-to-analog conversion circuit and adds error data to all pixel data of a corresponding screen in sync with a vertical synchronization signal, the error data having one value per one screen.

8 Claims, 11 Drawing Sheets

FIG.2A1
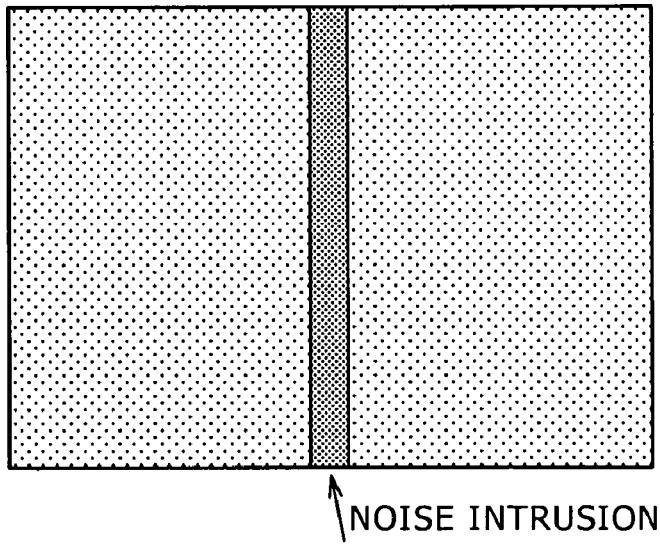
FIG.2A2
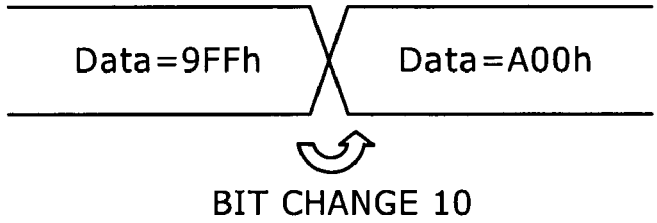
FIG.2B1
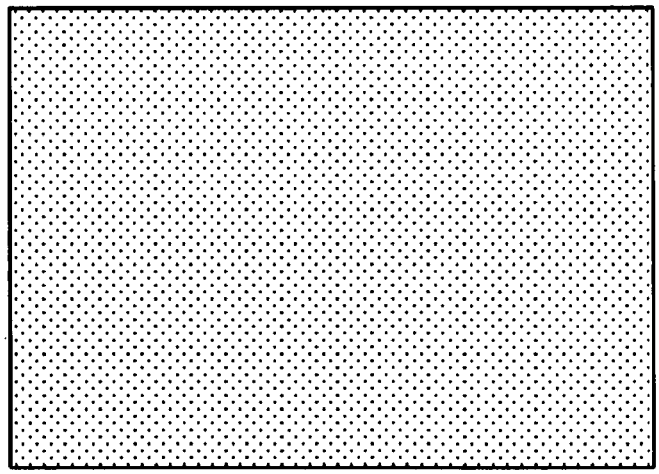
FIG.2B2
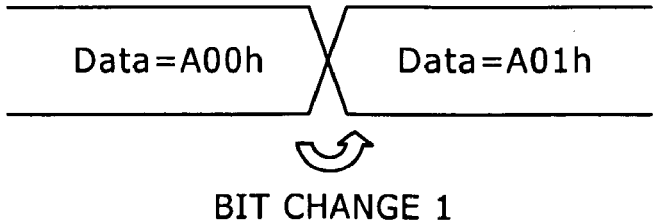

FIG.6A1
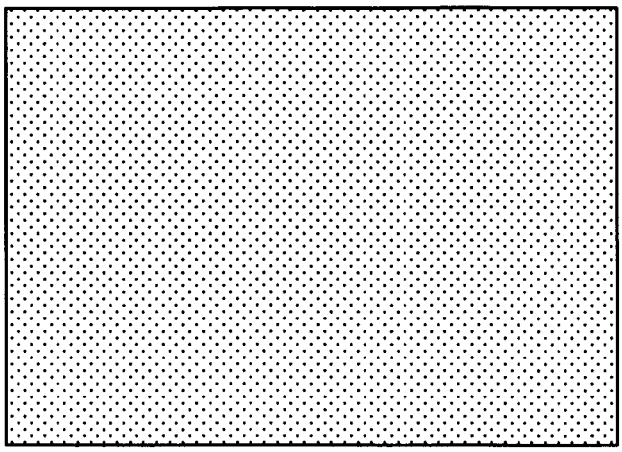
FIG.6A2
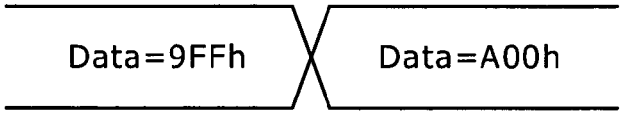
FIG.6B1
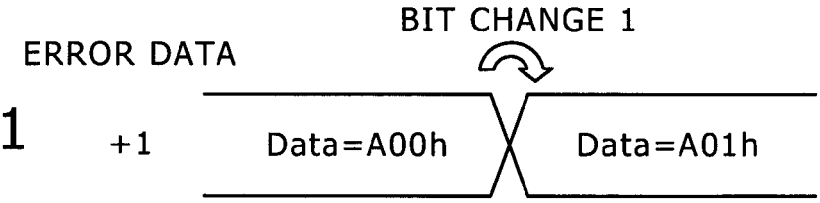
FIG.6B2
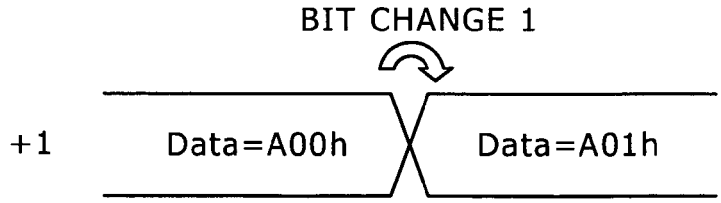
FIG.6B3
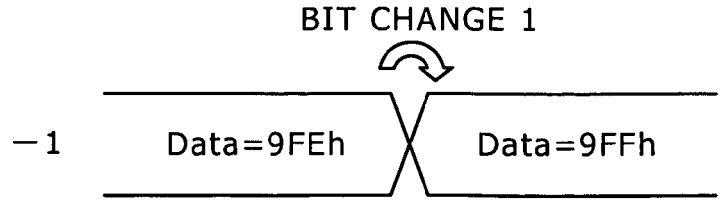
FIG.6B4
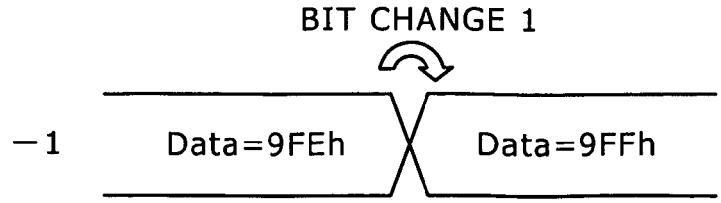

FIG.7A1
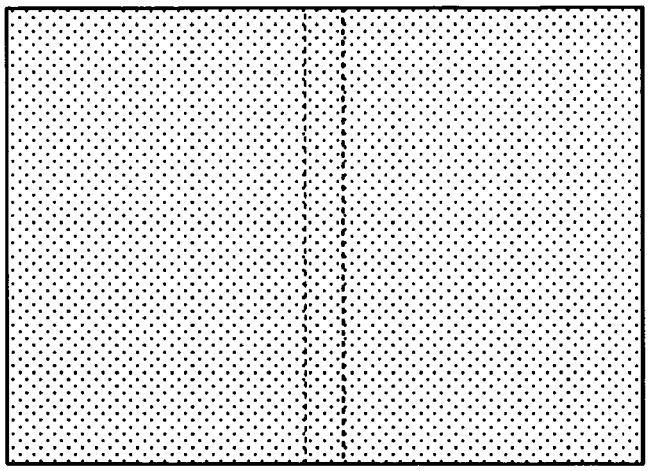
FIG.7A2
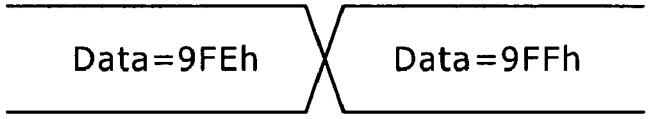
FIG.7B1
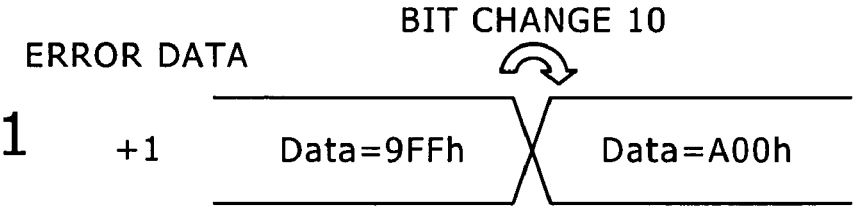
FIG.7B2
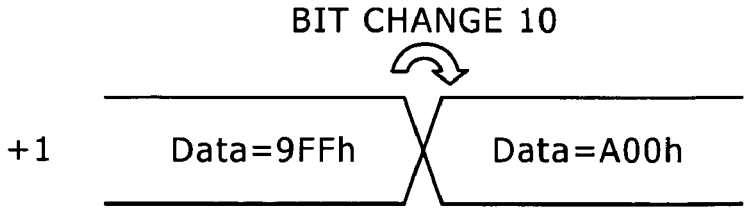
FIG.7B3
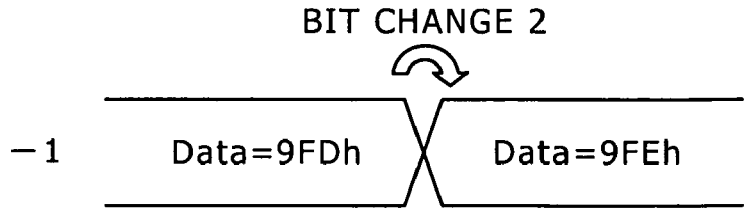
FIG.7B4
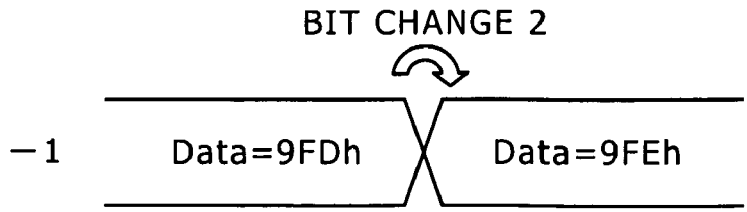

FIG.8A1
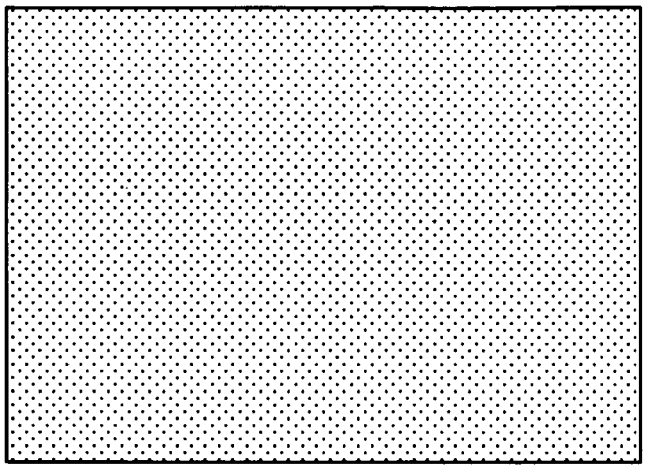
FIG.8A2
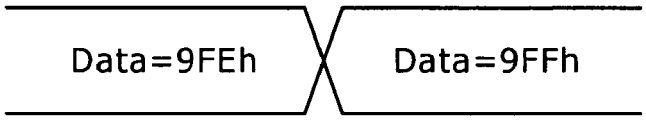
FIG.8B1
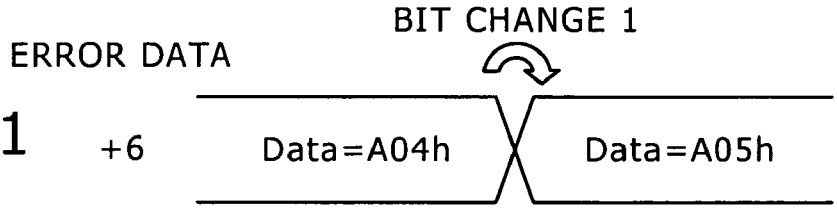
FIG.8B2
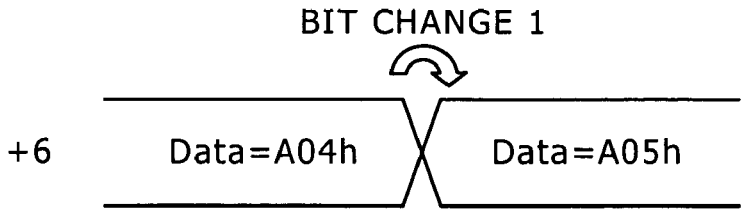
FIG.8B3
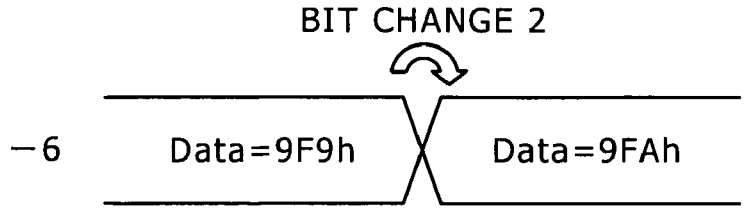
FIG.8B4
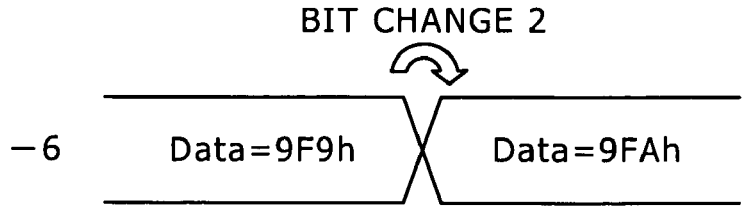

FIG.9A1
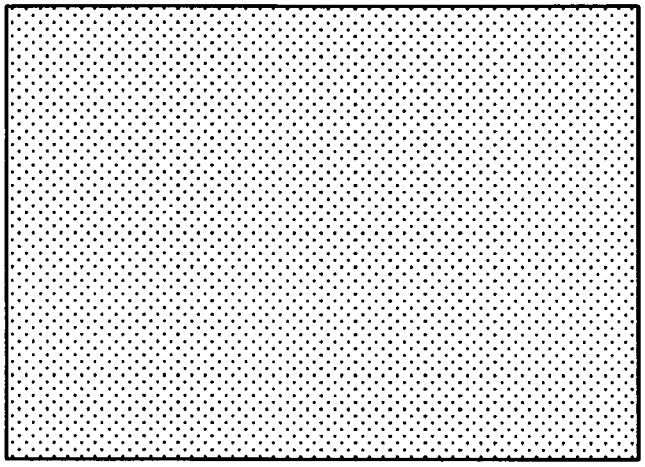
FIG.9A2
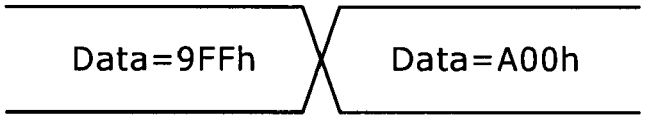
ERROR DATA
FIG.9B1 +6
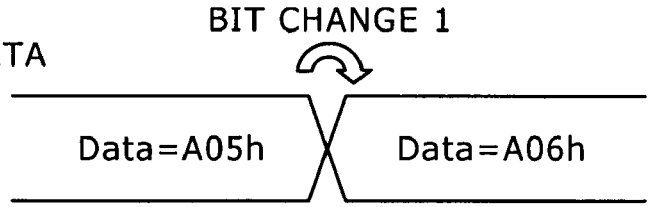
FIG.9B2 +6
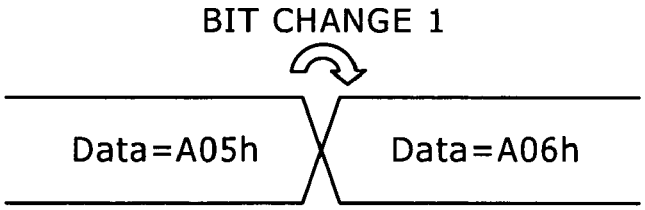
FIG.9B3 −6
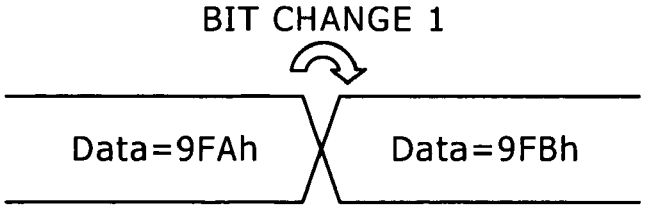
FIG.9B4 −6
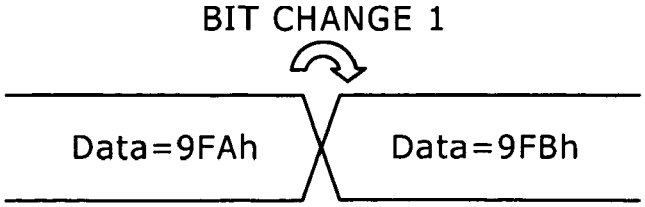

DISPLAY, LIQUID CRYSTAL DISPLAY, AND DATA PROCESSING METHOD FOR REDUCING INTERFERENCE DUE TO NOISE

CROSS REFERENCES TO RELATED APPLICATIONS

The present invention contains subject matter related to Japanese Patent Application JP 2005-176375 filed in the Japanese Patent Office on Jun. 16, 2005, the entire contents of which being incorporated herein by reference.

BACKGROUND OF THE INVENTION

1. Field of the Invention

One embodiment of the present invention relates to a display that treats image data with a large bit width. For example, some embodiments of the invention can be applied to liquid crystal displays, organic electro luminescence (EL) displays, plasma displays, field emission displays (FED), digital light processing (DLP) devices, and other displays.

Furthermore, another embodiment of the invention relates to a data processing method in a display.

2. Description of the Related Art

Currently, there is a trend that display devices are required to show a higher displaying performance for a higher resolution and a higher image quality. In step with this, the bit width of digital signal systems has been increasing.

In classical displays, a typical bit width is e.g. 24 bits as the sum of the respective 8 bits of R, G and B signals.

On the contrary, some recent displays employ a four-phase drive system in which each of R, G and B signals is composed of 12 bits. In this case, the bit width is as large as 12*4*3=144 bits.

SUMMARY OF THE INVENTION

However, an increase of the bit width leads to an increase of digital noise arising in a digital signal system. This digital noise intrudes into analog signal systems such as a D/A converter and a display panel as shown in FIG. 1, and thus becomes a factor in the interference of true reproduction of original images.

FIG. 2 shows an example of the interference. FIGS. 2A1 and 2B1 illustrate examples of displaying when a display device is supplied with image signals that offer almost uniform grayscale values across the entire screen.

The examples are based on image signals with digital data shown in FIGS. 2A2 and 2B2. According to the image signals, only 1 LSB of the digital data varies near the center of the screen, so that there is a data difference between the left and right sides of the screen.

Since the difference of the digital data is as small as only 1 LSB, it is expected that no strip interference pattern like one shown in FIG. 2A1 is generated on the screen.

However, in the digital data example of FIG. 2A2, the change of the digital data from '9FFh' to 'A00h', requires the change of 10 bits of the total 12 bits. Accordingly, the strip interference pattern shown in FIG. 2A1 will be caused due to the intrusion of the bit changes as noise into analog signal systems.

In contrast, no interference pattern is generated from digital data like the digital data example of FIG. 2B2, in which the digital data change from 'A00h' to 'A01h' causes the change of only 1 bit of the 12 bits.

Note that the difference between the digital data shown in FIG. 2A2 and that shown in FIG. 2B2 is 1 LSB. However, although grayscale values are thus almost identical, an interference pattern arises on a case-by-case basis depending on the number of bit changes on the digital data as described above.

As one related art, Japanese Patent Laid-open No. Hei 3-291691 discloses a technique to improve the displaying performance without an increase of the bit width. In this technique, white noise is added and subtracted to and from the entire screen to suppress the occurrence of false contouring, to thereby enhance the displaying performance. However, the superposition of white noise in this technique inevitably deteriorates the S/N ratio of displayed images.

In terms of the above-described technical problem, the present inventor proposes a display according to an embodiment of the invention, having the following processing function.

Specifically, the display includes a digital signal processing circuit that processes pixel data, and a digital-to-analog conversion circuit that converts pixel data that has been subjected to signal processing into an analog signal for driving a display device.

In addition, the display further includes an error data addition circuit that is provided at the previous stage of the digital-to-analog conversion circuit and adds error data having one value per one screen to all pixel data of the corresponding screen in sync with a vertical synchronization signal.

In the embodiment of the invention, error data with the same value is added to the entire screen in sync with a vertical synchronization signal. Due to the addition of the error data, even when the bit width is large, bit changes can be decreased or the occurrence frequency thereof can be lowered in an image part in which grayscale variation is comparatively small.

As a result, the occurrence of interference due to noise caused by the bit changes can be eliminated, or the frequency of interference can be decreased.

Furthermore, in the embodiment of the invention, since the error data with the same value is added to the entire screen, the S/N ratio is not deteriorated unlike the method of superimposing white noise. Although flicker is caused by changes of grayscales among the screens due to the superposition of error data, a human has a low sensitivity to flicker in terms of human visual characteristics. Therefore, the effect of image quality enhancement associated with an increase of the bit width can be achieved to the maximum extent.

BRIEF DESCRIPTION OF THE DRAWINGS

FIGS. 2A1 to 2B2 are diagrams for explaining the principle of noise intrusion;

FIGS. 6A1 to 6B4 are diagrams for explaining reduction of bit changes due to addition of error data;

FIGS. 7A1 to 7B4 are diagrams for explaining reduction of bit changes due to addition of error data;

FIGS. 8A1 to 8B4 are diagrams for explaining reduction of bit changes due to an increase of the amplitude of error data;

FIGS. 9A1 to 9B4 are diagrams for explaining reduction of bit changes due to an increase of the amplitude of error data;

DETAILED DESCRIPTION OF THE PREFERRED EMBODIMENTS

An embodiment of the invention as a liquid crystal display to which techniques relating to the invention are applied will be described below.

Part that is not particularly illustrated or described in the present specification may employ well-known or publicly-known techniques in the related technical field.

It should be noted that the following embodiment is merely one embodiment example of the invention, and the invention is not limited thereto.

Figure 3:
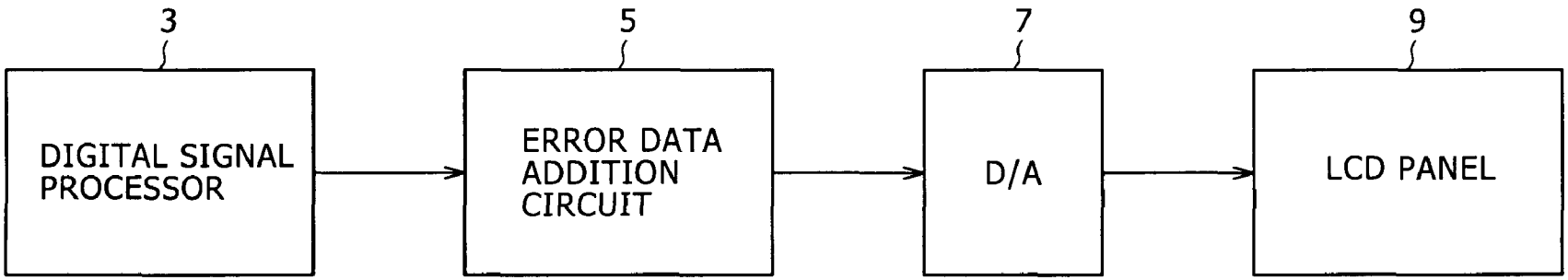
FIG. 3 is a diagram showing a configuration example of a liquid crystal display.

(A) Example of Application to Liquid Crystal Display (a) Entire Configuration FIG. 3 illustrates a configuration example of a liquid crystal display 1. This liquid crystal display can be applied both to direct-viewing-type devices and to projector-type devices.

The liquid crystal display 1 includes a digital signal processor 3, an error data addition circuit 5, a D/A conversion circuit 7, and an LCD panel 9.

Each of the digital signal processor 3, the D/A conversion circuit 7 and the LCD panel 9 has the configuration of an existing component.

The digital signal processor 3 is a processing device that executes data conversion processing for converting the format of an input signal to a format suitable as an output signal, gamma conversion processing, contrast processing, and other pre-processing.

In this example, the digital signal processor 3 outputs digital data with a bit width of 8 bits or more to the error data addition circuit 5.

The D/A conversion circuit 7 is a processing device that converts pixel data to which error data has been added into an analog signal.

The LCD panel 9 is formed of a liquid crystal shutter, a drive circuit thereof and a light source. The liquid crystal shutter has a structure in which, over a glass substrate, a transparent conductive film (pixel electrode), an alignment layer, a liquid crystal, an alignment layer, a transparent conductive film (counter electrode), and a glass substrate are sequentially deposited in that order.

If the LCD panel 9 employs a dynamic-drive system, the drive circuit is formed of a data line drive circuit and a gate line drive circuit. These circuits may be formed on a glass substrate by use of a semiconductor process, or alternatively may be formed on a semiconductor integrated circuit substrate. The light source may be based on a backlight system or alternatively may be based on a frontlight system.

(b) Configuration of Error Data Addition Circuit

The error data addition circuit 5 is a processing device that adds error data having one value per one screen to all pixel data of the corresponding screen in sync with a vertical synchronization signal Vsync.

Since this embodiment employs the LCD panel 9 as an output device, the error data also needs to satisfy the following condition. Specifically, it is required that the total sum of error data for even screens be equal to that for odd screens.

The reason for this requirement is because the LCD panel 9 is driven based on AC inversion driving.

More specifically, if the total sum of error data for even screens is not equal to that for odd screens, a DC component is produced, and the liquid crystal is deteriorated due to the DC component.

Figure 4:
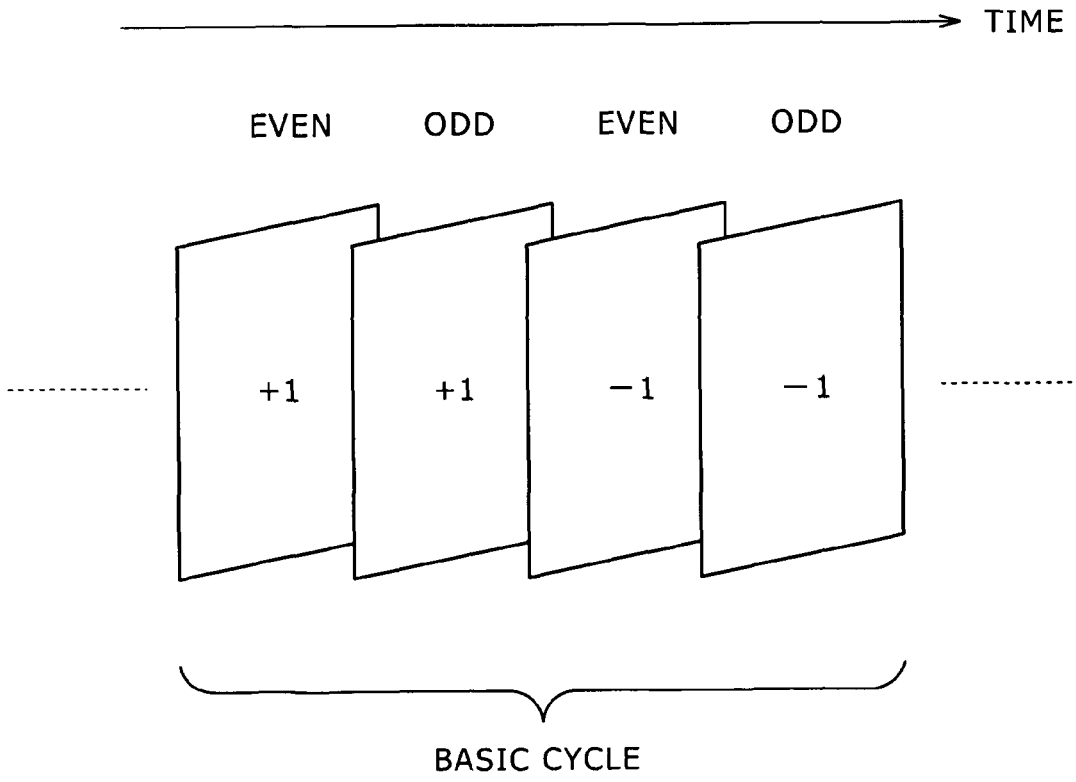
FIG. 4 is a diagram for explaining an example of the basic cycle of error data.

In the present embodiment, the basic cycle of the sequence of error data values is four screens. FIG. 4 shows an example of outputting of error data. In the example of FIG. 4, error data with a value of +1, +1, −1, and −1 in that order is sequentially output for per screen. In the example of FIG. 4, the total sum of the error data for the even screens is 0, and the total sum of the error data for the odd screens is also 0.

The unit screen of switching of the error data may be a field or alternatively may be a frame.

Figure 5:
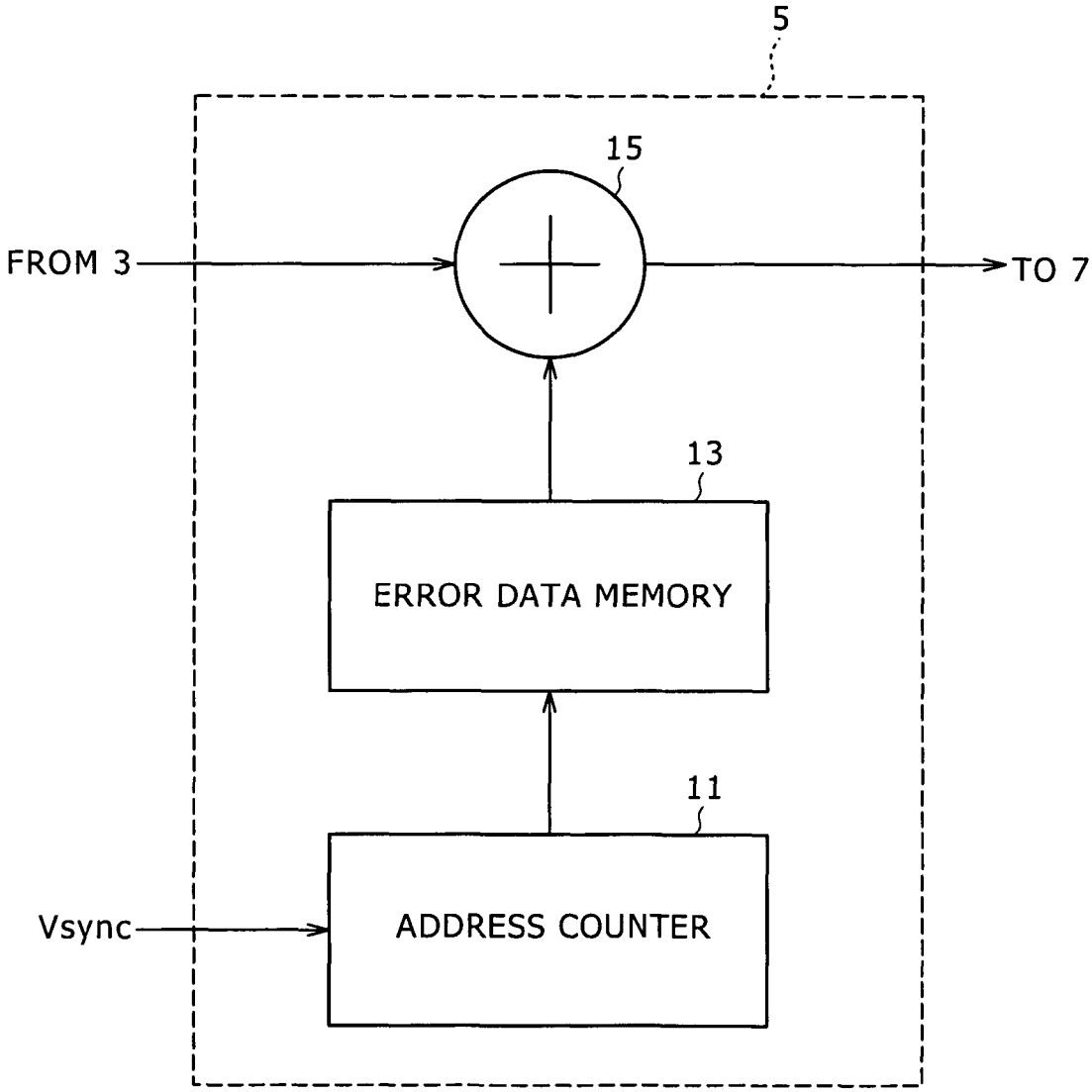
FIG. 5 is a diagram showing a configuration example of an error data addition circuit.

FIG. 5 illustrates a configuration example of the error data addition circuit 5. The error data addition circuit 5 includes an address counter 11, an error data memory 13 and an adder 15.

The address counter 11 is a counter that increments the count value by one every time the vertical synchronization signal Vsync is input thereto. If the basic cycle of error data is four screens as shown in FIG. 4, the address counter 11 cyclically generates four values of 0 to 3.

The addresses generated by the address counter 11 are used as read addresses for the error data memory 13. The address counter 11 corresponds to the address generator set forth in claims.

The error data memory 13 is a storage medium that stores the error data +1, +1, −1, and −1 so that these data values +1, +1, −1, and −1 are associated with the four addresses of 0 to 3, respectively. The error data memory 13 is formed of e.g. a ROM. Alternatively it may be a volatile semiconductor memory. More alternatively it may be a magnetic storage medium, an optical storage medium, or another storage medium. The error data memory 13 corresponds to the storage medium set forth in claims.

The adder 15 is an operator that adds one error data read out from the error data memory 13 to all pixel data of one screen in common.

The number of values of the error data per one screen is one. In terms of this point, the present embodiment is different in principle from the method of superimposing white noise.

All the pixels included in one screen are subjected to the addition of error data with the identical value. Therefore, the relative grayscale relationship among the pixels in the resulting image data is identical to that in the original image information. That is, the S/N ratio is not deteriorated.

(c) Processing Operation Example

The provision of the error data addition circuit 5 offers an advantage that, even when the bit width is large, bit changes can be decreased or the occurrence frequency thereof can be lowered in an image part in which grayscale variation is comparatively small. This advantage will be described below in detail with reference to FIGS. 6A1 to 6B4.

Figure 1:
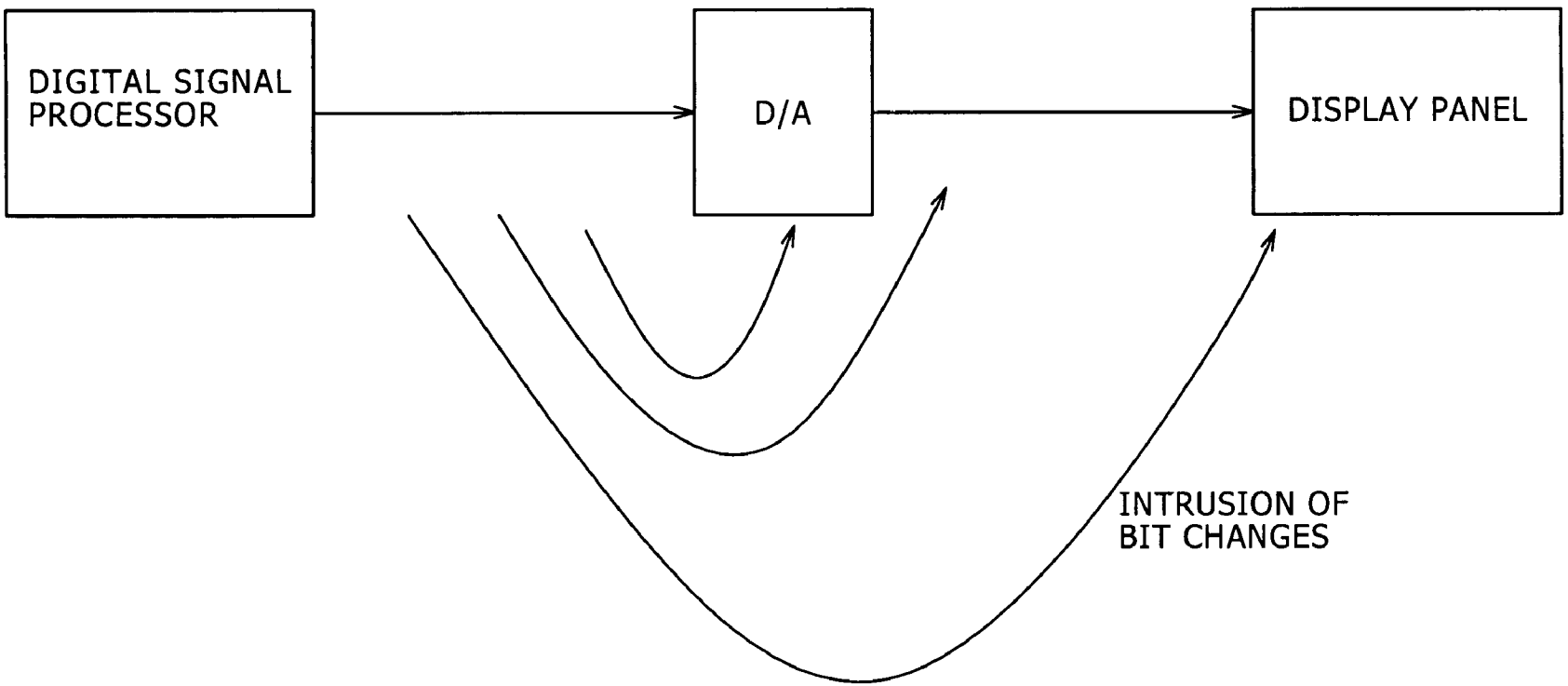
FIG. 1 is a diagram for explaining intrusion of digital noise.

FIG. 6A1 illustrates an example of displaying when a display device is supplied with image signals that offer almost uniform grayscale values across the entire screen.

The following description is based on an assumption that the digital data shown in FIG. 6A2 is supplied from the digital signal processor 3 to the error data addition circuit 5. This digital data is the same as the digital data that causes a strip interference pattern of the device in the past. Specifically, in this digital data, the data for the left side of the screen is expressed as '9FFh', while the data for the right side is expressed as 'A00h'.

FIGS. 6B1 to 6B4 show digital data that is to be input for each of consecutive four screens and results from conversion from the original data of FIG. 6A2 due to addition of error data thereto.

When the error data has a value of +1, the resulting digital data to be input to the D/A conversion circuit 7 is expressed as 'A00h' for the left side of the screen, and as 'A01h' for the right side. At this time, the number of the bit changes associated with the change between the data for the left screen and the data for the right screen is 1.

When the error data has a value of −1, the resulting digital data to be input to the D/A conversion circuit 7 is expressed as '9FEh' for the left side of the screen, and as '9FFh' for the right side. At this time, the number of the bit changes associated with the data change between the left and right sides is also 1.

That is, in displaying of any screen, the bit change arising at the boundary part between the left and right sides of the screen is decreased to 1. In contrast, the device in the past supplies the original data to the D/A conversion circuit directly, and therefore the number of the bit changes is 10.

In this manner, in the liquid crystal display described above as an embodiment of the invention, the occurrence of digital noise due to bit changes in an image part with comparatively small grayscale variation is suppressed, which avoids the generation of an interference pattern.

In some cases, the number of bit changes is still large even after the addition of error data, depending on digital data output from the digital signal processor 3. However, the period during which the number of bit changes is large is half as long as that of the system in the past, and therefore an image quality improvement can be achieved.

FIG. 7A2 shows an example of the digital data that leads to such bit changes.

Specifically, in this digital data, the data for the left side of the screen is expressed as '9FEh', while the data for the right side is expressed as '9FFh'.

FIGS. 7B1 to 7B4 show digital data that is to be input for each of consecutive four screens and results from conversion from the original data of FIG. 7A2 due to addition of error data thereto.

When the error data has a value of +1, the resulting digital data to be input to the D/A conversion circuit 7 is expressed as '9FFh' for the left side of the screen, and as 'A00h' for the right side. At this time, the number of the bit changes associated with the data change between the left and right sides is 10. This change amount is the same as that of the device in the past.

In contrast, when the error data has a value of −1, the resulting digital data to be input to the D/A conversion circuit 7 is expressed as '9FDh' for the left side of the screen, and as '9FEh' for the right side. At this time, the number of the bit changes associated with the data change between the left and right sides is 2. This change amount is a greatly reduced value compared with that of the device in the past.

As a result, the number of the bit changes arising at the boundary part between the left and right sides of a screen is switched between 10 and 2 at the two-screen cycle.

This case inevitably involves screens with many bit changes. Therefore, there is a possibility that digital noise due to the bit changes arises and thus an interference pattern is caused on these screens.

However, even when an interference pattern is caused on these screens, the subsequent two screens do not suffer from the occurrence of an interference pattern. In terms of this point, this embodiment is significantly different from the device in the past.

The reduction by half of the occurrence frequency of an interference pattern results in a great improvement of the image quality in terms of human visual characteristics.

FIG. 7A1 illustrates an example of the image with an improved image quality.

(d) Advantage

In the above-described embodiment, the error data addition circuit 5 is provided between the digital signal processor 3 and the D/A conversion circuit 7, and error data is added to all pixel data of the corresponding screen in sync with a vertical synchronization signal. The error data has one value per one screen and is defined so that the total sum of the error data for even screens is equal to that for odd screens. According to these features, bit changes can be decreased or the occurrence frequency thereof can be lowered in an image part in which grayscale variation is comparatively small, so that the image quality can be greatly enhanced.

(B) First Modification

In the above-described embodiment, error data is sequentially output for per screen in the order of +1, +1, −1, and −1.

However, the amplitude of the error data value can be increased so that the degree of image quality lowering due to flicker falls within the allowable range.

FIGS. 8A1 to 8B4 show a processing operation example when the amplitude of error data is from −6 to 6.

In the example of FIG. 8, the same digital data as that in FIG. 7 is processed. Specifically, as shown in FIG. 8A2, the digital data for the left side of the screen is expressed as '9FEh', while the digital data for the right side is expressed as '9FFh'.

FIGS. 8B1 to 8B4 show digital data that is to be input for each of consecutive four screens and results from conversion from the original data of FIG. 8A2 due to addition of error data thereto.

In this example, error data with a value of +6 or −6 is added.

When the error data has a value of +6, the resulting digital data to be input to the D/A conversion circuit 7 is expressed as 'A04h' for the left side of the screen, and as 'A05h' for the right side. At this time, the number of the bit changes associated with the data change between the left and right sides is 1.

In contrast, when the error data has a value of −6, the resulting digital data to be input to the D/A conversion circuit 7 is expressed as '9F9h' for the left side of the screen, and as '9FAh' for the right side. At this time, the number of the bit changes associated with the data change between the left and right sides is 2.

These change amounts are greatly smaller than that of the device in the past. As a result, the image quality is greatly improved as shown in FIG. 8A1.

As for the digital data of FIG. 6A2, even when the amplitude of error data is changed from 1 to 6, the same advantage of an image quality enhancement is achieved.

FIG. 9 shows a processing example for the digital data of FIG. 6A2 when the amplitude is 6. Specifically, as shown in FIG. 9A2, the digital data for the left side of the screen is expressed as '9FFh', while the digital data for the right side is expressed as 'A00h'.

FIGS. 9B1 to 9B4 show digital data that is to be input for each of consecutive four screens and results from conversion from the original data of FIG. 9A2 due to addition of error data thereto.

Also in this example, error data with a value of +6 or −6 is added.

When the error data has a value of +6, the resulting digital data to be input to the D/A conversion circuit 7 is expressed as 'A05h' for the left side of the screen, and as 'A06h', for the right side. At this time, the number of the bit changes associated with the data change between the left and right sides is 1.

In contrast, when the error data has a value of −6, the resulting digital data to be input to the D/A conversion circuit 7 is expressed as '9FAh' for the left side of the screen, and as '9FBh' for the right side. At this time, the number of the bit changes associated with the data change between the left and right sides is 1.

As described above, the number of bit changes can be decreased even when the amplitude of error data is increased.

(C) Second Modification

In the above-described embodiment, the error data addition circuit 5 is formed with use of the circuit configuration shown in FIG. 5.

However, the error data addition circuit 5 can be formed with use of another circuit configuration.

Figure 10:
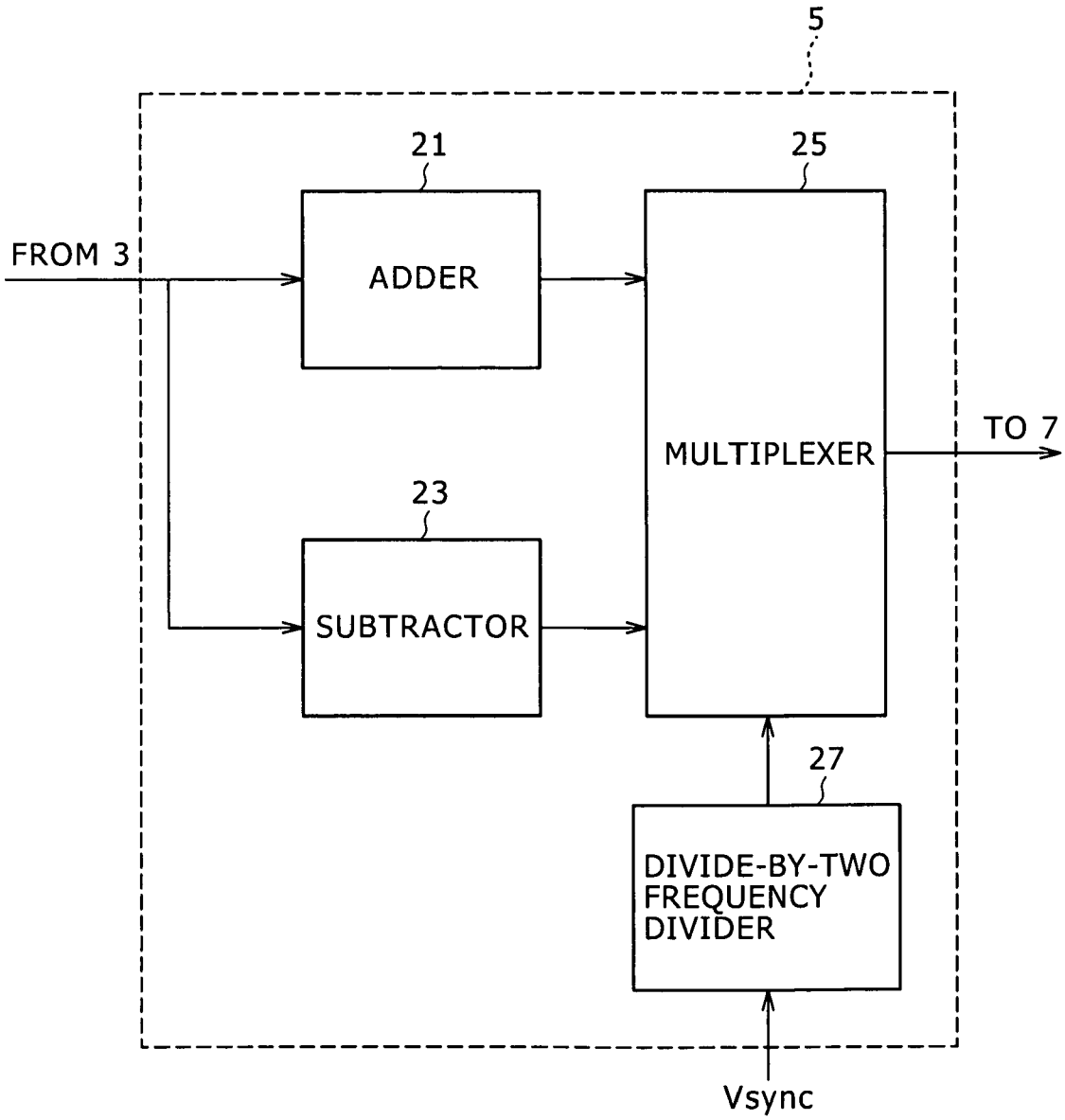
FIG. 10 is a diagram showing another configuration example of an error data addition circuit.

FIG. 10 illustrates another configuration example of the error data addition circuit 5. The error data addition circuit 5 includes an adder 21, a subtractor 23, a multiplexer 25, and a divide-by-two frequency divider 27.

The adder 21 is an operator that adds predetermined fixed error data (e.g. +1) to digital data.

The subtractor 23 is an operator that subtracts the same error data as the data of the adder 21 from digital data.

The multiplexer 25 is a data selector that selectively outputs either one of the digital data input from the adder 21 and the digital data input from the subtractor 23.

The divide-by-two frequency divider 27 is a circuit that divides the frequency of the input vertical synchronization signal Vsync by two to thereby produce a switching signal, and supplies the switching signal to the multiplexer 25. That is, the divide-by-two frequency divider 27 supplies the switching signal to the multiplexer 25 once every time the vertical synchronization signal Vsync is input twice.

Also when the error data addition circuit 5 has the configuration shown in FIG. 10, the same operation as that of the above-described embodiment can be achieved.

(D) Other Embodiments (a) In the above-described embodiment, the addition processing for error data is implemented by hardware. However, this processing may be implemented by software with use of a program. A computer that executes the processing may be incorporated in a liquid crystal display. This computer may also implement the processing of the digital signal processor 3 by software.

Figure 11:
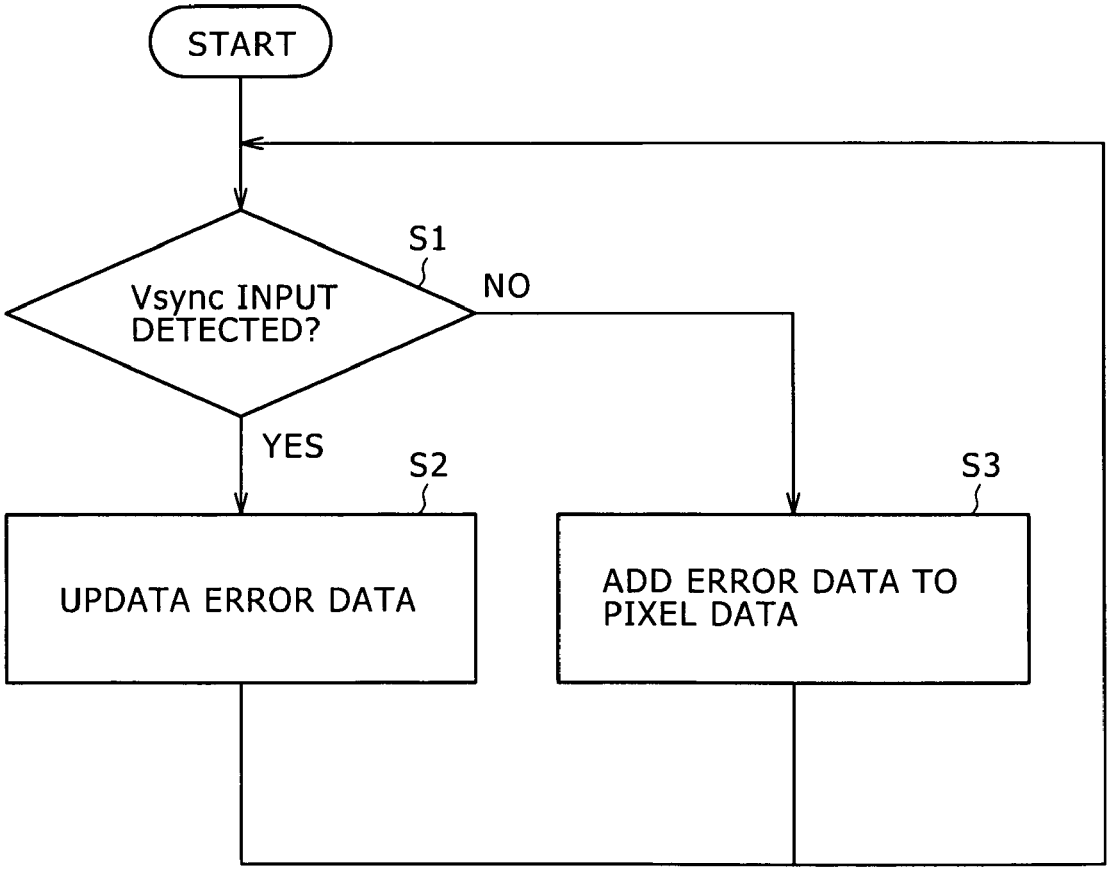
FIG. 11 is a diagram showing an example of a program for implementing a function of adding error data.

FIG. 11 shows an example of the processing procedure. Initially, the computer determines whether or not input of the vertical synchronization signal Vsync is detected (S1).

If the vertical synchronization signal Vsync is detected, the computer updates error data for processing a new screen (S2).

If the vertical synchronization signal Vsync is not detected, the computer adds currently set error data to pixel data (S3).

This series of the processing operation is repeatedly executed.

Specifically, the computer executes processing of adding error data to all pixel data of the corresponding screen in sync with the vertical synchronization signal Vsync.

For update of error data, a method in which error data is retrieved by use of read addresses may be employed like the above-described embodiment. Alternatively, a method in which, depending upon whether the count value is even or odd, the corresponding error data is used may be employed.

The program may be distributed via a network, or alternatively may be distributed with being stored in a storage medium. Examples of the storage media for the distribution include magnetic storage media, optical storage media, and semiconductor storage media.

(b) In the above-described embodiment, the value of error data is switched every time the vertical synchronization signal Vsync is input twice.

However, this switching cycle is not limited to two times of input of the signal. For example, the cycle may be one time, three times or four times of input of the signal. If the display as the output device is a liquid crystal display, it is desirable that the error data value be switched every time the vertical synchronization signal Vsync is input a number of times equal to an integer multiple of two.

If the switching cycle is four times of input of the signal, error data is output in the order of +1, +1, +1, +1, −1, −1, −1, and −1. It should be noted that the frequency resulting from the frequency division needs to be chosen so that perceptible flicker is not caused.

If a display that does not employ AC inversion driving is used as the output device, this switching cycle may be one time of input of the signal, or alternatively may be three times. For example, error data may be changed in the order of +1, −1, +1, and −1 on per screen basis.

(c) In the above-described embodiment, the absolute value of error data values is identical for all screens. Specifically, the error data value is switched on per even number of consecutive screens basis, and at each switching, the sign of the error data value is switched between the positive and negative signs while the absolute value thereof is kept the same.

However, the absolute value of the error data value may be changed on per even number of consecutive screens basis. For example, the error data value may be changed in the order of +1, +1, −3, and −3.

Alternatively, the absolute value may be changed on per screen basis. For example, an error data change of +1, +3, −1, and −3 in that order is also available.

In either case, the total sum of the error data for even screens is equal to that for odd screens. Therefore, the liquid crystal is not deteriorated.

(d) In the above-described embodiment, a liquid crystal display is employed as an application example. However, embodiments of the invention can also be applied to other displays.

For example, embodiments of the invention can be applied to organic EL displays, plasma displays, FEDs, DLP devices, and other displays.

(e) In the above-described embodiment, error data to be applied to the respective screens is defined so that the total sum of the error data for even screens is equal to that for odd screens.

This feature is effective also for displays other than liquid crystal displays. However, in displays that do not involve limitations relating to even screens and odd screens, error data may be defined so that the integration value thereof within a predetermined period is zero. In this case, a change of the average luminance of original images is avoided.

It should be noted that the integration value of error data may take a value other than zero.

(f) Various modifications might be incorporated into the above-described embodiment without departing from the scope of the invention. In addition, various modifications and applications that are created or combined based on the description of the present specification are also available.

What is claimed is:

1. A display comprising:

a digital signal processing circuit that converts a format of pixel data of an input signal to a format for an output signal having a predetermined bit width;

a digital-to-analog conversion circuit that converts the pixel data that has been subjected to signal processing into an analog signal for driving a display device; and an error data addition circuit which reduces interference due to noise, the error data addition circuit is connected to an output of the digital signal processing circuit and is directly connected to an input of the digital-to-analog conversion circuit and adds error data to a least significant bit of each pixel data of one screen in sync with a vertical synchronization signal, the error data having only one value per one screen.

2. The display according to claim 1, wherein a data value of the error data is switched on per even number of consecutive screens basis, and at each switching of the data value, a sign of the data value is switched between positive and negative signs while an absolute value of the data value is kept the same.

3. The display according to claim 1, wherein a switching cycle of the error data and an amplitude of the error data are determined so that a degree of an image quality decrease due to flicker falls within an allowable range.

4. The display according to claim 1, wherein the error data addition circuit comprising:

a storage medium that stores error data to be added to all pixel data in common on per screen basis;

an address generator that generates a read address in sync with the vertical synchronization signal; and an adder that adds error data retrieved in accordance with the read address to all pixel data of a corresponding screen.

5. The display according to claim 1, wherein the error data addition circuit includes:

an adder that adds fixed error data to all pixel data;

a subtractor that subtracts the fixed error data from all pixel data;

a data selector that receives an output from the adder and an output from the subtractor, and outputs either one of the outputs in accordance with a switching signal; and a frequency divider that divides a frequency of the vertical synchronization signal to thereby produce the switching signal to be applied to the data selector.

6. The display according to claim 1, wherein an integration value of the error data within a certain period is set to zero.

7. A liquid crystal display comprising:

a digital signal processing circuit that converts a format of pixel data of an input signal to a format for an output signal having a predetermined bit width;

a digital-to-analog conversion circuit that converts the pixel data that has been subjected to signal processing into an analog signal for driving a liquid crystal device; and an error data addition circuit which reduces interference due to noise, the error data addition circuit is connected to an output of the digital signal processing circuit and is directly connected to an input of the digital-to-analog conversion circuit and adds error data to a least significant bit of each pixel data of one screen in sync with a vertical synchronization signal, the error data having only one value per one screen and the error data being defined so that a total sum of the error data for even screens is equal to a total sum of the error data for odd screens.

8. A data processing method in a display including a digital signal processing circuit that converts a format of pixel data of an input signal to a format for an output signal having a predetermined bit width, and a digital-to-analog conversion circuit that converts the pixel data that has been subjected to signal processing into an analog signal for driving a display device, the method comprising the step of:

reducing interference due to noise by adding error data to a least significant bit of each pixel data, output by the digital signal processing circuit, of one screen in sync with a vertical synchronization signal prior to being directly input to the digital-to-analog conversion circuit, the error data having only one value per one screen.

* * * * *